US005564544A

United States Patent [19]

Takemoto et al.

[11] Patent Number: 5,564,544

[45] Date of Patent: Oct. 15, 1996

[54] BANK NOTE CONVEYING APPARATUS

[75] Inventors: Takatoshi Takemoto, Tokyo; Noriaki Kano, Hanamaki; Eiji Ito, Hanamaki; Koji Murakami, Hanamaki; Shoshiti Takahashi, Kitakami, all of Japan

[73] Assignee: Kabushiki Kaisha Ace Denken, Japan

[21] Appl. No.: 229,838

[22] Filed: Apr. 19, 1994

[51] Int. Cl.[6] ..... G07D 7/00; B65H 9/16

[52] U.S. Cl. ..... 194/206; 271/251

[58] Field of Search ..... 194/205, 206, 194/207, 344, 250; 271/251

[56] References Cited

U.S. PATENT DOCUMENTS

| | | | |
|---|---|---|---|
| 3,550,933 | 12/1970 | Wilson | 271/251 |
| 3,595,565 | 7/1971 | Bergland | 271/251 |
| 4,227,685 | 10/1980 | Fischer | 271/251 X |
| 4,426,073 | 1/1984 | Mizuma | 271/251 |
| 4,438,918 | 3/1984 | Ito et al. | 271/251 |
| 4,775,142 | 10/1988 | Silverberg | 271/251 |
| 5,004,220 | 4/1991 | Dreschel et al. | 271/251 X |
| 5,005,688 | 4/1991 | Yukimoto et al. | 194/206 |
| 5,114,137 | 5/1992 | Olson | 271/251 |
| 5,280,903 | 1/1994 | Herrick, Jr. | 271/251 |
| 5,316,117 | 5/1994 | Griner et al. | 194/206 X |
| 5,381,021 | 1/1995 | Polidoro | 271/251 X |

FOREIGN PATENT DOCUMENTS

| | | | |
|---|---|---|---|
| 48-95700 | 11/1973 | Japan . | |
| 58-164064 | 11/1983 | Japan . | |
| 61-92651 | 6/1986 | Japan . | |
| 62-5153 | 1/1987 | Japan . | |
| 3284567 | 12/1991 | Japan | 271/251 |
| 4-28649 | 1/1992 | Japan . | |
| 5-97293 | 4/1993 | Japan | 271/251 |
| 7600478 | 7/1977 | Netherlands | 271/251 |
| 9413564 | 6/1994 | WIPO | 271/251 |

*Primary Examiner*—Karen B. Merritt
*Assistant Examiner*—Scott L. Lowe
*Attorney, Agent, or Firm*—Andrus, Sceales, Starke & Sawall

[57] ABSTRACT

A bank note conveying apparatus which corrects the skew or the widthwise direction of the bank notes in the conveying path. The bank note conveying apparatus comprises a path forming member which forms a conveying path having a width larger than that of the bank note, and pinching roller mechanisms which send the bank notes in the conveying path in the conveying direction. The path forming member includes a bank note guide formed along one widthwise end of the conveying path. It also comprises a bank note widthwise arranging mechanism which directs the bank notes in the conveying path toward the bank note guide while feeding the bank notes in the conveying direction. The bank note widthwise arranging mechanism comprises an endless belt which is driven to come into contact with one of the two faces of the bank note, and rotatably supported balls which come into contact with the opposite face of the bank note.

4 Claims, 4 Drawing Sheets

BANK NOTE CONVEYING APPARATUS

FIELD OF THE INVENTION

The present invention relates to a bank note conveying apparatus used in moneychangers, etc. It especially relates to a bank note conveying apparatus which corrects the direction of bank notes being sent along a bank note conveying path and aligns the edges of the bank notes to one of the widthwise ends of the conveying path.

DESCRIPTION OF THE RELATED ART

In game parlors, for example pachinko game parlors, bank notes used by game players for and collected from a game media lending machine are introduced into a moneychanger for use as changing money so that the bank notes may rotatably be used again. Incidentally, as damaged bank notes may result in a jam in a conveying path, the collected bank notes have to go through a quality distinction stage so that only the good ones are used for changing money.

Previously, the quality distinction of the bank note was done by the clerk, etc., of the game parlor who checks the collected bank notes one by one and removes the badly damaged bank notes from the conveying path.

This quality distinction of bank notes can be done automatically, without using manual force, by a distinction apparatus. When using the distinction apparatus, the position and the direction of the bank notes have to be arranged. Previously, however, since there was no device which sets the position of the collected bank notes, the distinction apparatus could not be used; there was a problem that the distinction had to be done manually.

SUMMARY OF THE INVENTION

In view of the previous problems, the object of the present invention is to provide a bank note conveying apparatus which conveys bank notes along a conveying path, comprising: a path forming member forming the conveying path in a width larger than that of a bank note; the path forming member having a widthwise position guide provided along one widthwise end of the conveying path for arranging positions of the bank notes in the widthwise direction of the conveying path; a bank note conveying mechanism for sending the bank notes in the conveying path in the conveying direction; and a bank note widthwise arranging mechanism for directing the bank notes in the conveying path toward the widthwise position guide allowing conveyance of the bank notes in the conveying direction; the bank note widthwise arranging mechanism including an endless belt disposed in a position where it is contactable with either one of the faces of the bank notes and provided slantingly with respect to the conveying direction for directing the bank notes toward the widthwise position guide while feeding the bank notes in the conveying direction; an endless belt driving mechanism for rotating the endless belt; a rotating body disposed at a position where it is contactable with the opposite face of the bank notes and having a frictional force against the bank notes which is smaller than that between the endless belt and the bank notes; and a rotating body supporting mechanism which rotatably supports the rotating body.

The endless belt driving mechanism may comprise a driving pulley and a driven pulley between which the endless belt is fitted, a driving rotational shaft functioning as a rotation axis of the driving pulley and rotating the driving pulley, a driven rotational shaft functioning as a rotation axis of the driven pulley. The driving rotational shaft and the driven rotational shaft are in parallel to each other but slanted with reference to the conveying direction.

In one preferred form of the bank note conveying apparatus according to the present invention, the rotating body may be a ball, and the rotating body supporting mechanism may be so constructed that it supports the ball allowing the ball to be rotatable in all directions. Alternatively, the rotating body may be a cylindrical roller formed from a material whose friction coefficient against the bank notes is smaller than that between the endless belt and the bank note.

Or, the rotating body may be a roller whose periphery is in such a form as to make the roller contact the bank note substantially at a point.

When the bank note is introduced into the bank note conveying apparatus, the bank note is moved in the conveying direction through the conveying path by the bank note conveying mechanism.

The bank notes being conveyed through a conveying path wider than the width of the bank note, are not always arranged in order, but rather positioned irregularly or raggedly in the width direction of the conveying path. When these bank notes are pinched between the endless belt of the bank note widthwise arranging mechanism and the rotating body, the bank notes move in the conveying direction as well as toward the widthwise position guide to come into contact with the widthwise position guide. The bank notes which come into contact with the widthwise position guide are arranged in the widthwise direction of the conveying path, and the bank notes are arranged in parallel to each other.

The important thing here is that the frictional force between the rotating body and the bank note is smaller than the frictional force between the endless belt and the bank notes. Thus, the bank notes pinched between the endless belt and the rotating body can not only translate diagonally toward the widthwise position guide, but are rotatable. Therefore, bank notes introduced diagonally with respect to the conveying direction can change their direction to be in parallel to the widthwise position guide when they come into contact with the widthwise position guide.

PREFERRED EMBODIMENTS OF THE INVENTION

An embodiment of the present invention will be explained below, referring to the figures.

Figure 1:
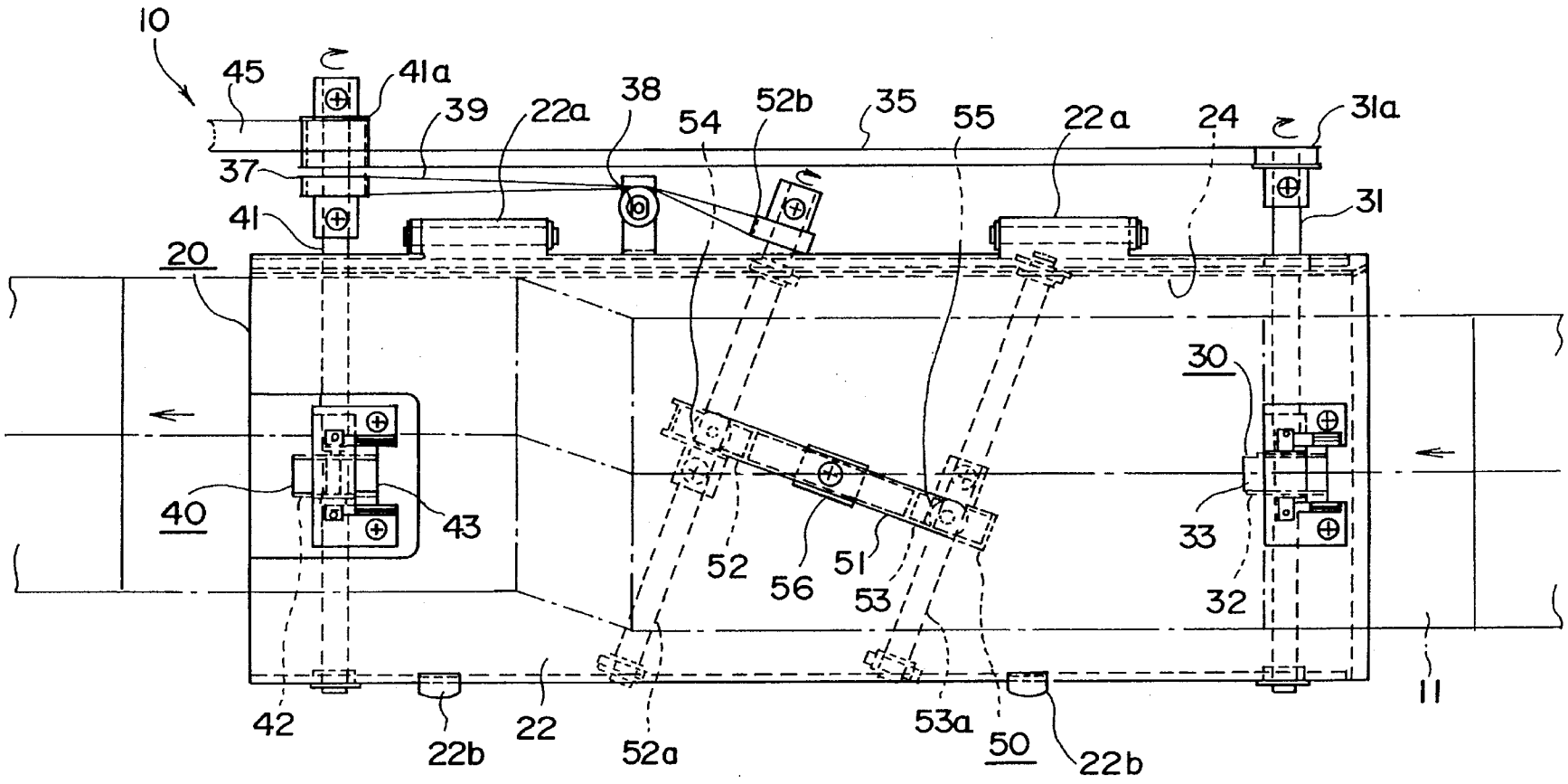
FIG. 1 is a front view of a bank note conveying apparatus in an embodiment of the present invention.
Figure 2:
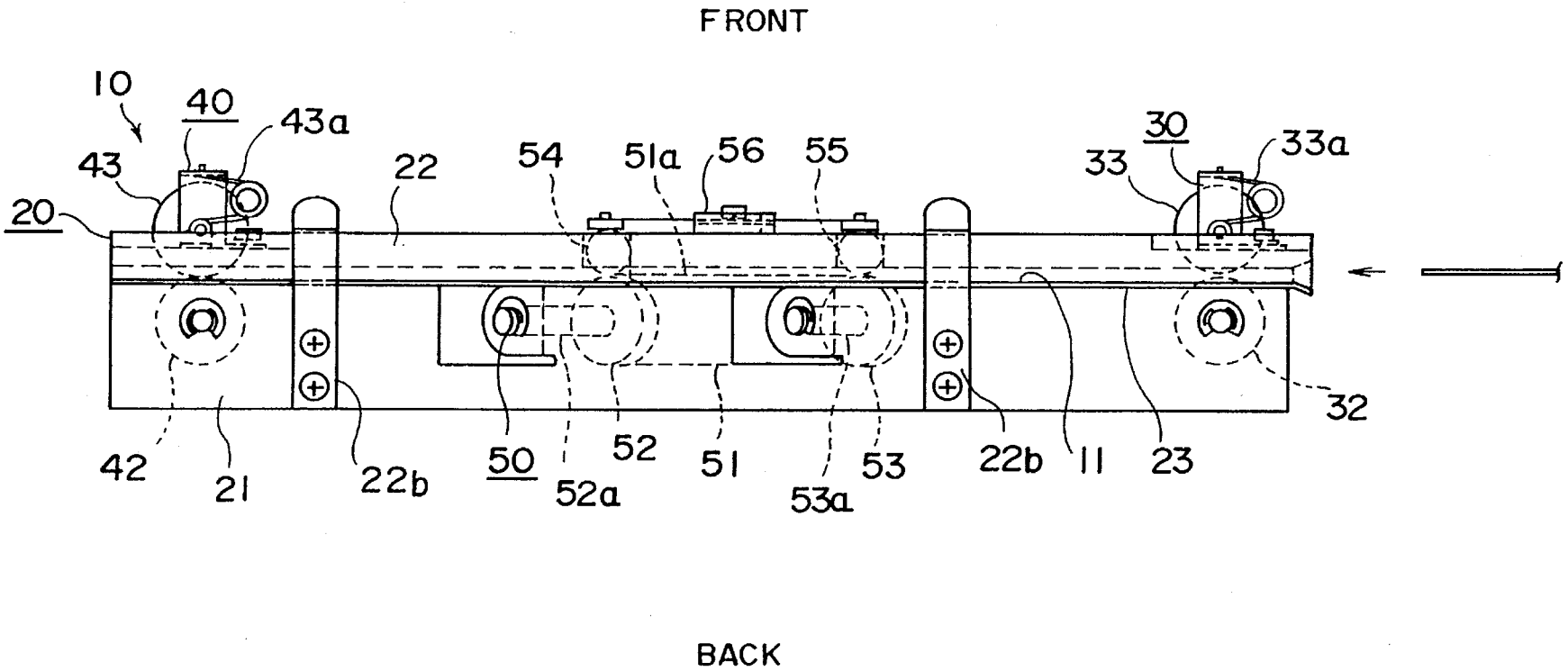
FIG. 2 is a side view of the bank note conveying apparatus in the embodiment of the present invention.
Figure 3:
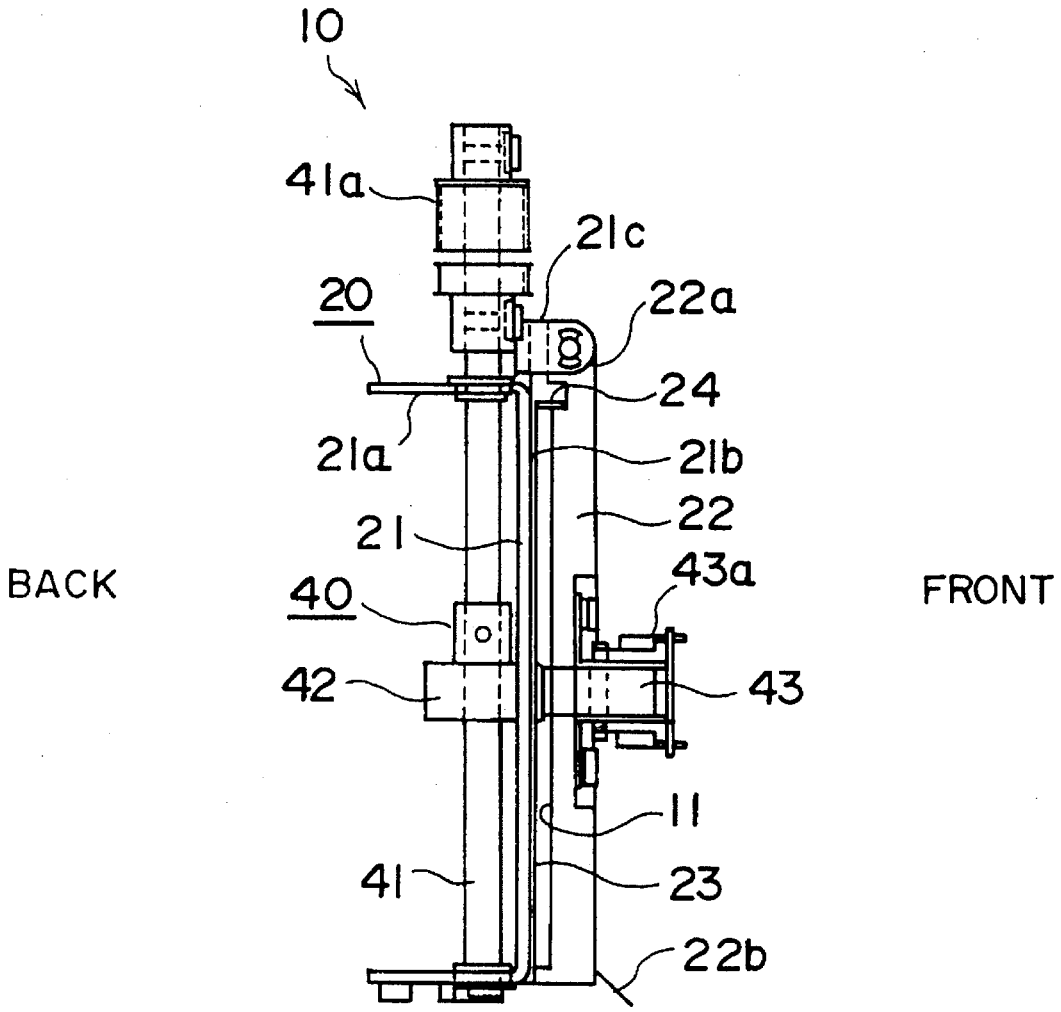
FIG. 3 is a side view of the bank note conveying apparatus in the embodiment of the present invention, showing a bank note pinching mechanism and a path forming member employable in the apparatus.

FIGS. 1 to 3 show an embodiment of the present invention.

As shown in FIG. 1, a bank note conveying apparatus 10 is provided in a moneychanger (not shown) to convey a bank note A, for example 1,000 yen bank note. The bank note conveying apparatus 10 comprises a path forming member 20 which forms a conveying path 11 for the bank note A, a first pinching roller mechanism 30 and a second pinching roller mechanism 40 for conveying the bank note A in the conveying path 11, and a bank note widthwise arranging mechanism 50. Looking at FIG. 1, the right side is the upstream (the beginning) and the left side is the downstream (the end) of the conveying path.

As shown in FIG. 3, the path forming member 20 comprises a supporting board 21, a first guide member 22, and a second guide member 23. The supporting board 21 extends along the direction of the path, and end portions thereof (more specifically, upper/lower end portions) 21*a*, 21*a* are bent backwards to form a channel. The second Guide member 23 is fixed to the front 21*b* of the supporting board 21. As shown in FIG. 2, one of side ends (an upper end) of the second guide member 23 is bent forwardly to form a bank note guide (widthwise position guide) 24.

The first guide member 22 extends over the front face of the second guide member 23 and has two projecting portions 22*a*, 22*a* provided at one side end (an upper side end) of the first guide member 22 and pinned to projections 21*c* of the supporting board 21, respectively. As shown in FIG. 2, the path forming member 20 forms the conveying path 11 defined between the first guide member 22 and the second guide member 23. The bank note guide 24 forms one of opposite widthwise side walls of the conveying path 11. The width of the conveying path 11 defined by the conveying guide 20 is larger, at an entrance of the path, than the width of the bank note A so that it is easy for the bank note A to be taken in.

As shown in FIG. 1 and FIG. 2, the first pinching roller mechanism 30 comprises a rotating shaft 31, a drive roller 32 fixed to the rotating shaft 31, and a driven roller 33 provided opposite to the drive roller 32 to be driven by the drive roller 32 through frictional transmission. The second pinching roller mechanism 40 comprises a rotating shaft 41, a drive roller 42 fixed to the rotating shaft 41, and a driven roller 43 provided opposite to the drive roller 42 to be driven by the drive roller 42 through frictional transmission.

Each rotating shaft 31 and 41 is extended in the direction perpendicular to the. conveying direction where the path forming member 20 extends. As shown in FIG. 2 and FIG. 3, the rotating shafts 31 and 41 are rotatably mounted in such a manner that they penetrate the end portions 21*a*, 21*a* of opposite side ends of the supporting board 21. A portion of each of the drive rollers 32 and 42 is projected to the conveying path 11 by passing through slots formed in the supporting board 21 and the second guide member 23, while a portion of each of the driven rollers 33 and 43 are projected to the conveying path 11 by passing through slots formed in the first guide 22. The driven rollers 33 and 43 are urged towards the drive rollers 32 and 42 by springs 33*a* and 43*a*, respectively.

As shown in FIG. 1, the first pinching roller mechanism 30 and the second pinching roller mechanism 40 are provided in such a way that the space between them is longer than the length of the bank note A. A pulley 31*a* is fixed at one end of the rotating shaft 31 of the first pinching roller mechanism 30, and similarly, a pulley 41*a* is fixed at one end of the rotating shaft 41 of the second pinching roller mechanism 40. A power transmitting belt 35 is provided between the pulley 31*a* and the pulley 41*a*. Further, a drive belt 45 is provided between the pulley 41*a* and a drive shaft of a motor (not shown).

By the drive of the motor: the first pinching roller mechanism 30 and the second pinching roller mechanism 40 are operated at an even speed; the bank note A is pinched between the drive roller 32 and the driven roller 33 of the first pinching roller mechanism 30 so that the bank note A moves along the conveying path 11 according to the rotation of rollers 32 and 33 in the conveying direction; and the bank note A is then pinched between the drive roller 42 and the driven roller 43 of the second pinching roller mechanism 40 so that the bank note A further moves along the conveying path 11 according to the rotation of rollers 42 and 43 in the conveying direction.

As shown in FIG. 1, the bank note widthwise arranging mechanism 50 is provided in the middle position between the first pinching roller mechanism 30 and the second pinching roller mechanism 40. The bank note widthwise arranging mechanism 50 is a mechanism for correcting the direction of the bank note A by arranging the length of the bank note A being sent through the conveying path 11 to be parallel to the bank note guide 24.

As shown in FIG. 1 and FIG. 2, the bank note widthwise arranging mechanism 50 comprises an endless belt 51 provided at a rear side of the conveying path 11, a drive pulley 52 and a driven pulley 53 which the endless belt 51 is placed over, two balls 54 and 55 provided at a front side of the conveying path 11 so as to face the endless belt 51, and a ball supporting device 56 which supports balls 54 and 55.

The drive pulley 52 and the driven pulley 53 are mounted on rotating shafts 52*a* and 53*a*, respectively. Each of the rotating shafts 53*a* and 52*a* is rotatably mounted on the end portion 21*a* of the supporting board 21 of the path forming member 20 in such a manner that they slant from the widthwise bank note guide 24 side to the other side of the conveying path 11 from the upstream side to the downstream side of the conveying path 11 as shown in FIG. 1. The drive pulley 52 is positioned at a side closer to the bank note guide 24 than the driven pulley 53, and the drive pulley 52 and the driven pulley 53 are projected to the conveying path 11 through slots formed in the supporting board 21. As the pulleys 52 and 53 are arranged in the manner as specified above, the endless belt 51 provided between pulleys 52 and 53 slants toward the longitudinal direction (the conveying direction) of the bank note conveying path 11.

At an end portion projected from the conveying path 11 of the rotating shaft 52*a*, a pulley 52*b* is mounted. As shown in FIG. 1, a power transmitting belt 39 is provided between the pulley 52*b* and a pulley 37 mounted on the rotating shaft 41 of the second pinching roller mechanism 40 via a pulley 38 projected from the supporting board 21. Therefore, by the drive of a motor (not shown), the drive roller 32 of the first pinching roller mechanism 30, the driven roller 42 of the second pinching roller mechanism 40, and the endless belt 51 of the widthwise arranging mechanism 50 will rotate at an even peripheral speed.

The two balls 54 and 55 are provided at the forward side of the conveying path 11 in the position facing the endless belt 51 and within the opening of the second guide member 22. Each of the balls 54 and 55 is partly projected into the conveying path 11 from an opening of the second guide member 22 to pinch the bank note A in cooperation with the endless belt 51. The two balls 54 and 55 are urged rearwardly, namely towards the endless belt 51 side, by the resiliency of the ball supporting device 56. The ball supporting device 56 which rotatably supports the two balls 54 and 55 is fixed to the first guide member 22.

The pinching force to be applied to the bank note A by the endless bell 51 and the two balls 54 and 55 is adjusted to be less than the pinching force to be applied to the bank note A by the first pinching roller mechanism 30 or the second pinching roller mechanism 40.

The distance between the driven pulley 53 at the upstream side of the bank note widthwise arranging mechanism 50 and the rollers 32, 33 of the first pinching roller mechanism 30 and the distance between the drive pulley 52 at the downstream side of the bank note widthwise arranging mechanism 50 and the rollers 42 and 43 of the second pinching roller mechanism 40 are each set to be shorter than the length of the bank note A.

The operation will now be explained.

In FIG. 1, when the bank note A is inserted, in a direction of an arrow, into the conveying path 11 between the upper guide 22 and the lower guide 23 of the conveying guide 20, the bank note A is pinched between the drive roller 32 and the driven roller 33 of the first pinching roller mechanism 30 to be moved in the conveying direction of the conveying path 11. The bank note A is, thereafter, pinched between a conveying surface 51*a* of the endless belt 51 in the bank note widthwise arranging mechanism 50 and the ball 55 at the upstream side and moved with the rotation of the endless belt 51.

The bank note A is temporarily in a condition where it is conveyed by both mechanisms 30 and 50 while moving from the first pinching roller mechanism 30 to the bank note widthwise arranging mechanism 50. At this time, the bank note A maintains the direction in which it is pinched by the rollers 32 and 33 of the first pinching roller mechanism 30, and the speed given by the first pinching roller mechanism 30. The bank note A moves as it is because the pinching force of the first pinching roller mechanism 30 applied to the bank note A is less than the pinching force of the bank note widthwise arranging mechanism 50 applied to on the bank note A when the bank note A is pinched between the endless belt 51 of the bank note widthwise arranging mechanism 50 and the ball 55 at the upstream side; also because the conveying power of the first pinching roller mechanism 30 is stronger than that of the conveying power of the bank note widthwise arranging mechanism 50, since ball 55 of the bank note widthwise arranging mechanism 50 contacts the bank note A only at a point. Moreover, the pinching force of the bank note widthwise arranging mechanism 50 on the bank note A is applied by the ball supporting device 56 which urges the ball 55 towards the endless belt 51.

As the endless belt 51 of the bank note widthwise arranging mechanism 50 has the conveying surface 51*a* which moves along the conveying path 11 from the upstream side to the downstream side and is slanted from one widthwise side of the path to the other side, namely to the bank note guide 24 side, the bank note A changes its course by the endless belt 51 according to the moving direction of the belt and moves towards the bank note guide 24 side while moving to the downstream side, as soon as the rear end of the bank note A comes off from the first pinching roller mechanism 30. When the upper front end portion of the bank note A hits the bank note guide 24, the moving direction changes, and the bank note moves along the guide 24 in the downstream direction with an entire length of the bank note A in contact with the guide 24.

At this time, the bank note A is pinched between the endless belt 51 and the two balls 54 and 55. Since the two balls 54 and 55 are supported by the ball supporting part so as to be rotatable in all directions, they rotate according to the moving direction of the bank note A. The sliding frictional force of each of the two balls 54 and 55 with the bank note A, is much smaller than the sliding frictional force between the endless belt 51 and the bank note A because the balls 54 and 55 each contact the bank note only at a point. Thus, for example, when the bank note A comes into the bank note widthwise arranging mechanism 50 while assuming a posture where the length of the bank note A is slanting toward the bank note guide 24, the bank note A does not just simply move in the longitudinal direction of the endless belt 51, but the rear end of the bank note A rotates around its upper front end when its upper front end comes into contact with the bank note guide 24. Thus, the entire length of the bank note A comes into contact with the bank note guide 24.

In this way, the bank note A proceeds to the downstream side along the bank note guide 24 in the condition where its length is in contact with the bank note guide 24. When the front end of the bank note A reaches the second pinching roller mechanism 40, the bank note A is then pinched between the drive roller 42 and the driven roller 43 of the second pinching roller mechanism 40 so that it is further moved along the conveying path 11 with the rotation of the second pinching roller 40 in the downstream direction (the conveying direction).

In the present embodiment, as described above, the direction and the widthwise position in the bank note conveying path 11 of the bank note A can be corrected by the bank note widthwise arranging mechanism 50 and the bank note guide 24, although the direction of each bank note A which comes into the bank note conveying path 11 and the widthwise position of it in the bank note conveying path 11 are incorrect. Owing to this advantage, the bank note quality distinction apparatus for determining the degree of degradation of the bank note can be introduced to omit the manual quality distinction operation.

Next, various types of rotating bodies which are employable in the present invention for pinching the bank note A in cooperation with the endless belt 51 will be explained using FIGS. 4A, 4B 5A, 5B, 6A and 6B.

Figure 4A:
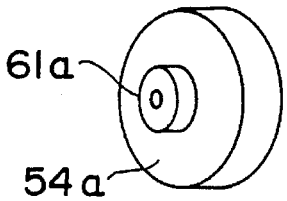
FIG. 4A is a perspective view of a rotating body employable in the present invention.
Figure 4B:
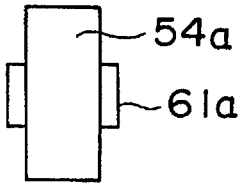
FIG. 4B is a front view of the rotating body shown in FIG. 4A.

As shown in FIGS. 4A and 4B, a cylindrical roller 54*a* may be used as a rotating body instead of the balls 54 and 55. Roller 54*a* has a bearing 61*a* at a central portion thereof. The bearing 61*a* receives a rotating shaft (not shown), and the roller 54*a* rotates around this rotating shaft. This rotating shaft extends in parallel to the rotating shafts 52*a* and 53*a* of pulleys 52 and 53 of the bank note widthwise arranging mechanism 50 when it is mounted.

In the foregoing embodiment, the correction of the bank note A is done by balls 54 and 55 being supported in such a way that they are rotatable in all directions. However, if the cylindrical roller 54*a* is used and it is supported by the rotating axis as in the embodiment shown, the rotating direction of the roller 54*a* will be regulated to certain directions. Thus, a material having a friction coefficient between roller 54*a* and bank note A is smaller than that between endless belt 51 and bank note A is used for the roller 54*a*, so that the bank note A is pinched between the endless belt 51 of the bank note widthwise arranging mechanism 50 and the roller 54*a* can change its direction freely. In other words, by using a roller 54*a* with a small frictional force in relation to the bank note A, the bank note A slides against the roller 54*a* to change its direction. Further, Teflon resin, for example, is an appropriate material to be used for roller 54*a*.

Figure 5A:
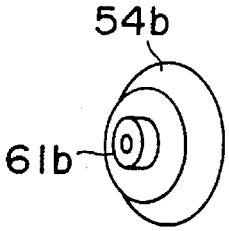
FIG. 5A is a perspective view of another form of rotating body employable in the present invention.
Figure 5B:
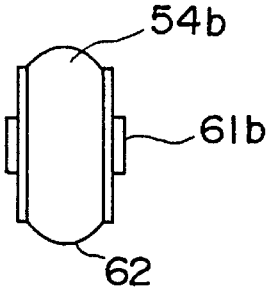
FIG. 5B is a front view of the rotating body shown in FIG. 5A.

Moreover, as shown in FIGS. 5A and 5B, a beer barrel like roller 54*b* may be used as a rotating body. In other words, the roller 54*b* having a periphery as shown in FIG. 5B may also be used. In roller 54*b*, a bearing 61*b* is provided at its center. At bearing 61*b*, a rotating shaft (not shown) is mounted so that the roller 54*b* rotates around this rotating axis. When the roller 54*b* having this form is used, the roller 54*b* comes into contact with the bank note A only at a point where an apex of the curved periphery is, and the sliding friction between the roller 54*b* and the bank note A will become smaller than that between the endless belt 51 and the bank note A. Therefore, the bank note A slides against the roller 54*b* to change the direction of the bank note A.

Figure 6A:
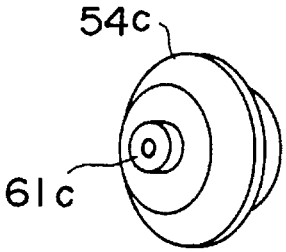
FIG. 6A is a perspective view of still another form of rotating body employable in the present invention.
Figure 6B:
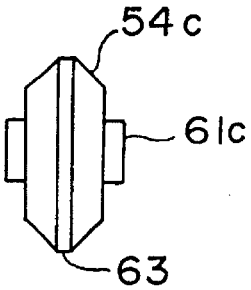
FIG. 6B is a front view of the rotating body shown in FIG. 6A.

Furthermore, as shown in FIGS. 6A and 6B, a roller 54*c* having a periphery in the form of an even-legged trapezoid may be used as well. The periphery of the roller 54*c* comes into contact, at its apex portion of the trapezoid, with the bank note A. In the roller 54*c*, a bearing 61*c* is provided at the center. At bearing 61*c*, a rotating shaft (not shown) is fitted so that roller 54*c* rotates around this rotating shaft. When the roller 54*c* in this form is used, the area of contact between the roller 54*c* and the bank note A becomes small, which results in the frictional force between the roller 54*c* and the bank note A being smaller than the frictional force between the endless belt 51 and the bank note A. Therefore, the bank note A slides against the roller 54*c* to change its direction, just like the foregoing rotating bodies.

What is claimed is:

1. A bank note conveying apparatus which conveys bank notes along a conveying path in a conveying direction, comprising:

a path forming member forming the conveying path in a width larger than that of a bank note;

said path forming member having a widthwise position guide provided along one widthwise end of the conveying path for arranging positions of the bank notes in a widthwise direction of the conveying path;

a first pinching roller mechanism and a second pinching roller mechanism for sending the bank notes in the conveying path in the conveying direction;

a bank note widthwise arranging mechanism for directing the bank notes in the conveying path toward the widthwise position guide allowing conveyance of the bank notes in the conveying direction; and an interlocking mechanism for driving said first pinching roller mechanism and said second pinching roller mechanism in conjunction with said bank note widthwise arranging mechanism;

said first pinching roller mechanism and said second pinching roller mechanism respectively including:

a driving roller for conveying the bank notes in the conveying direction and being contactable with either one of two faces of the bank notes;

a driving rotating shaft for said driving roller which extends in a direction perpendicular to the conveying direction;

a driven roller which rotates in accordance with the movement of the bank note in the conveying path, said driven roller being provided opposite said driving roller and being contactable with another face of the bank notes;

a driven rotating shaft for said driven roller which extends in a direction perpendicular to the conveying direction; and a rotating shaft driving pulley which is fixed to said driving rotating shaft;

said bank note widthwise arranging mechanism including a widthwise arranging endless belt disposed between said driving roller of said first pinching roller mechanism and said driving roller of said second pinching roller mechanism, and disposed in a position where it is contactable with either one of the faces of the bank notes and provided slantingly with respect to the conveying direction for directing the bank notes toward said widthwise position guide while feeding the bank notes in the conveying direction;

a driving pulley and a driven pulley over which said widthwise arranging endless belt is looped;

a driving rotating shaft of said driving pulley provided slantingly with respect to the conveying direction and which extends in a direction perpendicular to said widthwise arranging endless belt;

a driven rotating shaft of said driven pulley being disposed parallel to said driving rotating shaft;

a rotating shaft driving pulley fixed on said driving rotating shaft;

a rotating body disposed at a position where it is contactable with the face of the bank notes opposite to that contacted by said endless belt and having a frictional force against the bank notes which is smaller than that between the widthwise arranging endless belt and the bank notes; and a rotating body supporting mechanism which rotatably supports the rotating body;

said driving roller of said first pinching roller mechanism and said driving roller of said second pinching roller mechanism being arranged so that the distance therebetween is longer than the longitudinal length of the bank notes; and said driving roller of said first pinching roller mechanism and said rotating body of said bank note widthwise arranging mechanism being arranged, and said driving roller of said second pinching roller mechanism and said rotating body of said bank note widthwise arranging mechanism being arranged, such that the respective distance therebetween is shorter than the longitudinal length of the bank notes;

said interlocking mechanism including:

an interlocking pulley which is fixed to one of said driving rotating shafts of said first pinching roller mechanism and said second pinching roller mechanism;

a first interlocking endless belt looped over said interlocking pulley and said rotating shaft driving pulley of said bank note widthwise arranging mechanism;

a second interlocking endless belt looped over said rotating shaft driving pulley of said first pinching roller mechanism and said rotating shaft driving pulley of said second pinching roller mechanism; and a shaft rotating mechanism for rotating one of said driving rotating shafts of said first pinching roller mechanism and said second pinching roller mechanism.

2. The bank note conveying apparatus according to claim 1, wherein said rotating body is a ball, and said rotating body supporting mechanism supports said ball so as to be rotatable in all directions.

3. The bank note conveying apparatus according to claim 1, wherein said rotating body is a cylindrical roller formed from a material whose friction coefficient against the bank notes is smaller than that between the endless belt and the bank note.

4. The bank note conveying apparatus according to claim 1, wherein said rotating body is a roller whose periphery is in a form which allows the roller to contact the bank notes substantially at a point.

* * * * *